United States Patent [19]

Porzelius

[11] Patent Number: 4,502,167

[45] Date of Patent: Mar. 5, 1985

[54] APPARATUS FOR SECURING A TOILET BOWL LID CLOSED

[76] Inventor: Christian S. Porzelius, R. #1, El Paso, Ill. 61738

[21] Appl. No.: 551,832

[22] Filed: Nov. 15, 1983

[51] Int. Cl.[3] ..... A47K 13/24

[52] U.S. Cl. ..... 4/253

[58] Field of Search ..... 4/234, 227, 239, 251, 4/253; 292/63, 67, 258, 288; 16/286, 307

[56] References Cited

U.S. PATENT DOCUMENTS

| | | | |
|---|---|---|---|
| 2,546,535 | 3/1951 | Barry | 292/63 |
| 2,651,053 | 9/1953 | Rowe et al. | 4/253 |
| 2,698,439 | 1/1955 | Bruckner | 4/253 |
| 2,737,044 | 3/1956 | Christensen et al. | 292/205 X |
| 3,056,972 | 10/1962 | Miller | 4/253 |
| 3,116,527 | 1/1964 | Springer | 4/253 |
| 3,431,004 | 3/1969 | Schell | 292/258 |
| 4,060,851 | 12/1977 | Lawrence et al. | 4/253 |

*Primary Examiner*—Charles E. Phillips

*Attorney, Agent, or Firm*—Burns, Doane, Swecker & Mathis

[57] ABSTRACT

A lock for a toilet lid comprises a bracket securable to a toilet bowl, and a post mounted to the bracket so as to be swingable to a retracted position away from the bowl against a first spring bias. A locking arm is mounted to the post and is movable relative thereto into a position overlying the toilet lid, in order to prevent the lid from being opened. The locking arm is secured to the post in a manner which prevents the locking arm from being moved out of its overlying relationship with the lid unless the post is in its retracted position. The post can be swung 180 degrees to enable the locking arm to be moved to a stored position.

11 Claims, 3 Drawing Figures

APPARATUS FOR SECURING A TOILET BOWL LID CLOSED

BACKGROUND AND OBJECTS OF THE INVENTION

The present invention relates to locks for toilet bowl lids.

Toilet bowls present an attraction to curious infants, due especially to the presence of water in the bowl. At the same time, the toilet is a source of danger, since serious harm may befall an infant who accidentally falls into an open bowl. Moreover, an infant may attempt to drop items into the water, which items may be of value and/or can clog the plumbing.

Numerous suggestions for locking toilet bowl lids have been proposed, in an effort to minimize these dangers, as exemplified, for example in Schell U.S. Pat. Ser. No. 3,431,004 issued Mar. 4, 1969; Miller U.S. Pat. Ser. No. 3,056,972 issued Oct. 9, 1972; Lawrence et al U.S. Pat. Ser. No. 4,060,851 issued Dec. 6, 1977; Rowe et al U.S. Pat. Ser. No. 2,651,053 issued Sept. 8, 1953; and Bruckner U.S. Pat. Ser. No. 2,698,439 issued Jan. 4, 1955.

However, the devices disclosed in these patents do not satisfy all of the following requirements of a toilet lid lock, namely, that the lock be (i) reliably infant-proof and yet easily actuated by an older child or adult, (ii) easily attached to a toilet bowl; and (iii) easily movable between retracted and locking positions.

It is, therefore, an object of the present invention to minimize or obviate problems of the type discussed above.

Another object of the invention is to provide a novel locking apparatus for a toilet lid.

A further object of the invention is to provide a toilet lid locking mechanism which is infant-proof and yet easily actuated by an older child or adult.

An additional object of the invention is to provide a toilet lid lock which is easily attached to a toilet bowl and is easily movable between retracted and locking positions.

SUMMARY OF THE INVENTION

These objects are achieved by the present invention which relates to a lock for a toilet lid. The lock comprises a mounting bracket adapted to be secured to a toilet bowl such that a section of the bracket is disposed outside of the bowl. A post is mounted at one end to such section of the bracket so as to be swingable to a retracted position in a direction away from the toilet bowl against a first spring-bias. A locking arm is mounted to the other end of the post so as to be movable relative to the post into a position overlying the toilet lid when the post is in an upright orientation. As a result, the lid is prevented from being opened. The locking arm carries a first securing structure which is engageable with a second securing structure on the post to secure the locking arm in overlying relationship with the toilet lid. The first and second securing structures are arranged to be mutually disengageable only when the post is in its retracted position. The locking arm is movable out of its overlying relationship with the toilet lid when the first and second securing structures are mutually disengaged, in order to enable the toilet lid to be raised.

THE DRAWINGS

The objects and advantages of the invention will become apparent from the following detailed description of a preferred embodiment thereof, in connection with the accompanying drawings, in which like numerals designate like elements, and in which.

DETAILED DESCRIPTION OF A PREFERRED EMBODIMENT OF THE INVENTION

Figure 1:
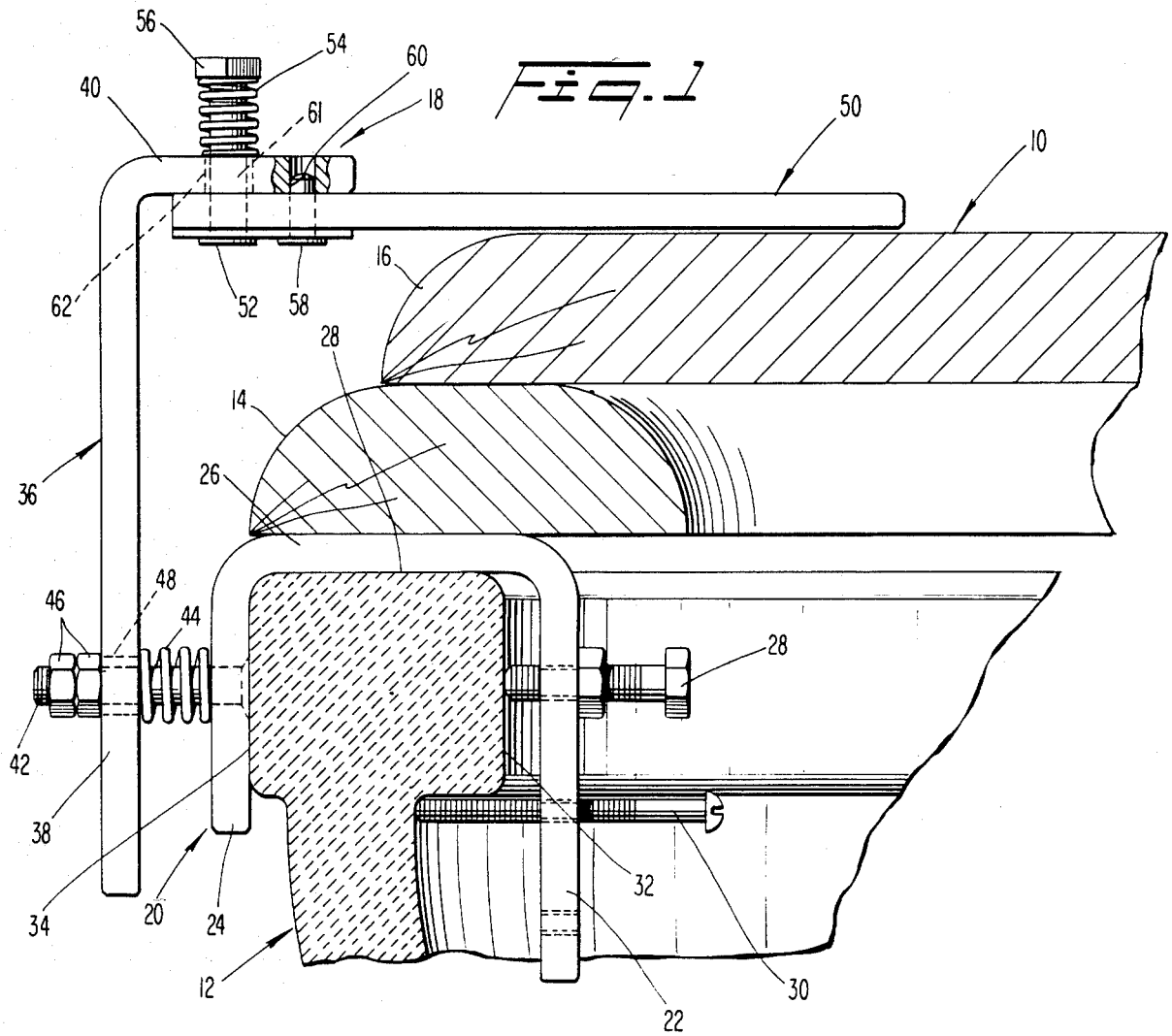
FIG. 1 is a vertical sectional view taken through a portion of a toilet bowl, with the seat and lid thereof in closed positions, and with a locking mechanism according to the present invention oriented to prevent opening of the lid.

In FIG. 1 there is depicted a portion of a conventional indooor flush toilet 10 comprising a bowl 12, a swingable seat 14 and a swingable lid 16 for the bowl.

A toilet lid locking mechanism 18 according to the present invention serves to releasably lock the lid 16 such that it cannot be opened by an infant. The locking mechanism 18 comprises a mounting bracket 20 of generally inverted U-shaped construction. The bracket 20 includes inner and outer parallel legs 22, 24 and a bight 26 interconnecting the legs. The bracket 20 is adapted to fit over the rim 28 of the toilet bowl 12 such that a longer one of the legs, i.e., the inner leg 22, extends vertically downwardly within the bowl and a shorter one of the legs, i.e., the outer leg 24, extends vertically downwardly along the outside of the bowl.

A pair of set screws 28, 30 are threadedly mounted within the inner leg. An upper one of the screws 28 is situated so as to be engageable with a side surface 32 of the rim of the bowl, and the lower one 30 of the screws extends beneath the rim. The upper screw 28 enables the outer leg 24 to be pulled snugly against an outer surface 34 of the rim, and the lower screw 30 prevents inadvertent removal of the mechanism from the bowl.

Connected to the bracket 20 is a post 36. The post comprises a base portion 38 and a finger portion 40 extending laterally from one end of the base portion 38. The base portion 38 is mounted to the bracket 20 for rotation relative thereto by means of a bolt 42 which interconnects the outer leg 24 of the bracket 20 and the base portion 38 of the post 36. A coil compression spring 44 is mounted on the bolt 42 and is disposed between the outer leg 24 and the base portion 38 to urge those two components apart. A pair of nuts 46 are mounted on a threaded end of the bolt 42 to secure the post 36 and bracket 20 in a selected spaced relationship. An aperture 48 in the post through which the bolt 42 extends is of larger diameter than the bolt, to enable the leg 40 of the post 36 to swing toward (and away from) the toilet bowl 12 against the bias of the spring 44 (see FIG. 2). The post 36 can also rotate relative to the bracket 20 about an axis defined by the bolt 42.

Mounted on the finger portion 40 is a locking arm 50. The locking arm 50 is rotatable relative to the post about an axis defined by a bolt 52 which extends through the finger portion 40 and the locking arm 50. A second coil compression spring 54 is disposed around a projecting end of the bolt 52 and is secured in place by means of a nut 56 which is screwed onto the projecting end of the second bolt.

Figure 2:
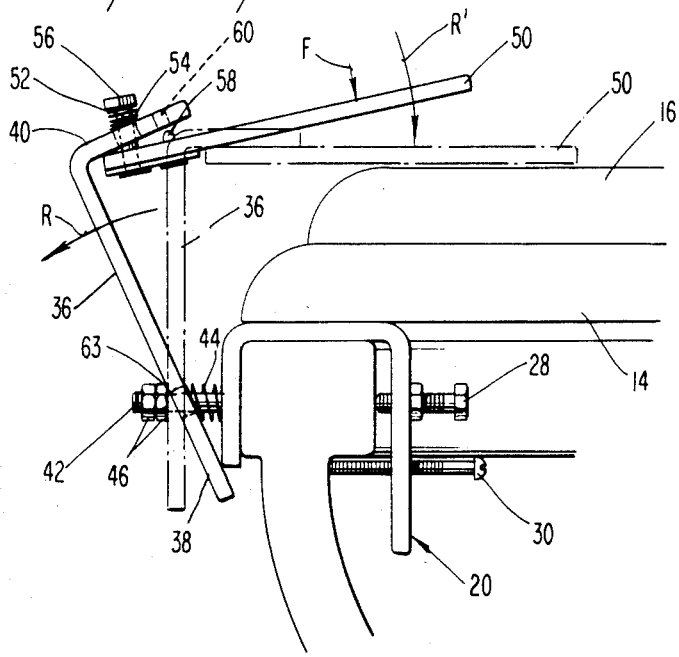
FIG. 2 is a view similar to FIG. 1, depicting the locking mechanism in a retracted position during a lid unlocking sequence.

Fixedly secured to the locking arm 50 is a securing pin 58 which projects beyond the locking arm and toward the finger portion 40. The projecting end of this pin 58 is adapted to enter a hole 60 in the finger portion 40 upon being aligned therewith. Although the locking arm 50 is biased into flush engagement with the finger portion 40 by the second spring 54, the securing pin 58 is adapted to be displaced out of the hole 60 in the finger portion by the manual application of a suitable force F to the locking arm as depicted in FIG. 2. Such movement of the locking arm 50 can be accommodated by an arrangement wherein the diameter of the shank 61 of the second bolt 52 is less than the diameter of the hole 62 in the locking arm through which the shank second bolt 52 extends.

From the foregoing, it will be appreciated that the post 36 is swingable relative to the bracket 20 about the first bolt 42. That is, the post can be swung in a direction R (FIG. 2) about an axis defined by an upper edge 63 of one of the nuts 46 and extending perpendicularly to the plane of the paper to raise the locking arm upwardly away from the lid 16. This enables the locking arm to be swung downwardly in a direction R′ upon the application of force F, whereby the pin 58 leaves the hole 60. The locking arm 50 can then be swung 90 degrees about an axis defined by the bolt 52, thereby enabling the post 36 to be swung 180 degrees downwardly about an axis defined by the bolt 42 such that the locking arm 50 and finger 40 are transported to an out-of-the-way position beneath the rim of the bowl (FIG. 3).

The spacing between the bight 26 of the bracket and the locking arm 50 when the post is in an upright position (FIG. 1) is substantially equal to the combined heights of the toilet seat 14 and lid 16. Thus, when the locking arm 1 overlies the lid, and the locking pin is seated within the hole 60 in the finger portion 40, the arm 50 prevents the lid from being opened. Even if an upward force is applied to the lid 16, causing the post to swivel away from the toilet bowl, the post will be unable to swivel far enough to permit the lid to be opened to any significant extent, as is evident from the solid line portion of the arm 50 shown in FIG. 2.

Figure 3:
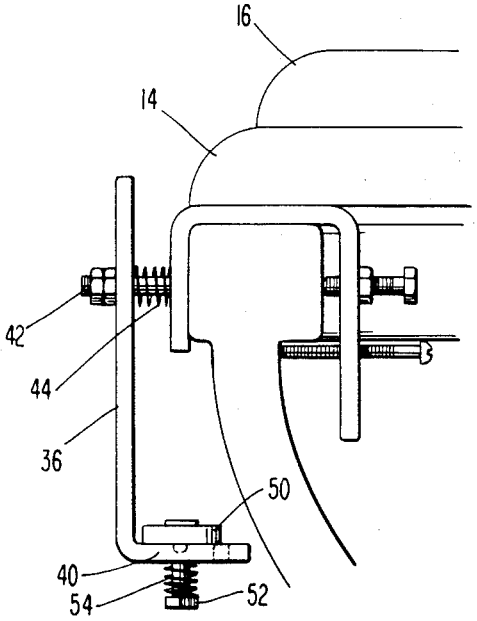
FIG. 3 is a view similar to FIG. 2 after the locking arm has been rotated 90 degrees and the post has been rotated 180 degrees, in order to move the locking arm to a stored position.

In operation, if it is desired to unlock the lid 16, it is merely necessary to (i) swing the post 36 out about the axis 63 (FIG. 2), (ii) push down upon the arm 50 to slide the securing pin 58 out of the hole 60 (such movement can be aided by also pushing down upon the nut 56 of the second bolt 52), (iii) rotate the arm 50 by 90 degrees about the axis of the second bolt 52, and (iv) swivel the post 36 about the axis of bolt 42 by 180 degrees to a stored position (FIG. 3).

Locking of the lid is performed by a reversal of the above-described steps.

It will be appreciated that the locking mechanism of the present invention creates a positive locking of the toilet lid. That is, the lid remains locked even in the presence of substantial lifting forces, i.e., more force than an infant could apply. Furthermore, unlocking can be achieved only by a prescribed manipulation of the post and locking arm which is simple for an older child or adult, but too difficult for an infant. Also, when the lock is not in use, it is stored neatly out of the way.

Although the present invention has been described in connection with a preferred embodiment thereof, it will be appreciated by those skilled in the art that additions, modifications, substitutions, and deletions not specifically described, may be made without departing from the spirit and scope of the invention as defined in the appended claims.

What is claimed is:

1. A lock for a toilet lid, comprising:

a mounting bracket adapted to be secured to a toilet bowl such that a section of the bracket is disposed outside of the bowl, a post mounted at one end to said section of said bracket so as to be swingable to a retracted position in a direction away from the toilet bowl against a first spring bias, a locking arm mounted to the other end of said post so as to be movable relative to said post into a position overlying the toilet lid with the post in an upright orientation, in order to prevent the lid from being opened, said locking arm carrying first securing means which is engageable with second securing means on said post to secure said locking arm in overlying relationship with the toilet lid, said first and second securing means being arranged to be mutually disengageable only with said post in said retracted position, said locking arm being movable out of said overlying relationship when said first and second securing means are mutually disengaged in order to enable the toilet lid to be opened.

2. A lock according to claim 1, including means creating a second spring bias opposing mutual disengagement of said first and second locking means.

3. A lock according to claim 1, wherein said first securing means comprises a pin on said locking arm and said second securing means comprises a hole in said post.

4. A lock according to claim 1, wherein said post comprises a finger portion which overlies said locking arm when the latter is in its lid-locking poistion, said second securing means being disposed on said finger portion.

5. A lock according to claim 4, wherein said locking arm is mounted to said finger portion by a bolt which forms an axis of rotation about which said locking arm rotates between its overlying and non-overlying positions.

6. A lock according to claim 5, wherein said locking arm is swingable downwardly away from said finger portion to mutually disengage said first and second securing means.

7. A lock according to claim 6, wherein said first and second securing means comprise a pin and hole connection.

8. A lock according to claim 7, wherein said spring bias which opposes movement of said post to said retracted position comprises a first spring disposed between said post and said bracket.

9. A lock according to claim 8, wherein a second spring is arranged to resist downward swiveling movement of said locking arm.

10. A lock according to claim 9, wherein said post is mounted to said bracket for rotation about a horizontal axis to enable said post and locking arm to be rotated downwardly to an out-of-the-way poisition when said locking arm is in its non-overlying relationship.

11. A lock for a toilet lid, comprising:

a bracket of generally inverted U-shape including first and second parallel vertical legs interconnected by a bight, said bracket being adapted for connection to a toilet bowl with said first leg disposed within the bowl and said second leg situated outside of the bowl, a post having a first end connected to said bracket by means permitting movement of said post relative to said bracket:

in a first rotary direction enabling said post to be moved between raised and lowered positions, and in a second rotary direction toward a retracted position away from the bowl against a first spring bias, said post including a lateral finger portion disposed at an end of said post opposite said first end, said finger portion extending in the general direction of the bowl with said post in a raised position, a locking arm mounted beneath said finger portion by means permitting movement of said locking arm relative to said finger portion:

in a first swinging direction against a second spring bias such that an outer end of said locking arm moves away from said finger portion, said locking arm being movable in said first swinging direction only when said post is in said retracted position such that said locking arm is spaced above the lid, and in a second swinging direction about an axis which is upright when said post is upright such that said locking arm can be moved between a position overlying the lid to secure same and a non-overlying position relative to the lid to release same, and said locking arm and said finger portion carrying first and second securing means, respectively, said first and second securing means being mutually disengageable in response to movement of said locking arm in said first swinging direction to enable the locking arm to be rotatable to said non-overlying position for releasing the lid.

* * * * *